US005792583A

United States Patent [19]

Sano et al.

[11] Patent Number: 5,792,583

[45] Date of Patent: Aug. 11, 1998

[54] TONER FOR DEVELOPING ELECTROSTATIC LATENT IMAGE

[75] Inventors: Tetsuo Sano; Yoshitaka Sekiguchi, both of Amagasaki, Japan

[73] Assignee: Minolta Co., Ltd., Osaka, Japan

[21] Appl. No.: 572,124

[22] Filed: Dec. 14, 1995

[30] Foreign Application Priority Data

Dec. 15, 1994 [JP] Japan ..... 6-311630

[51] Int. Cl.[6] ..... G03G 9/087

[52] U.S. Cl. ..... 430/109; 430/904; 430/903

[58] Field of Search ..... 430/109, 904, 430/903

[56] References Cited

U.S. PATENT DOCUMENTS

| | | | |
|---|---|---|---|
| 4,810,612 | 3/1989 | Ueda et al. . | |
| 4,833,057 | 5/1989 | Misawa et al. . | |
| 4,857,433 | 8/1989 | Shin et al. | 430/109 |
| 4,863,824 | 9/1989 | Uchida et al. . | |
| 4,917,982 | 4/1990 | Tomono et al. . | |
| 4,939,060 | 7/1990 | Tomiyama et al. . | |
| 5,079,123 | 1/1992 | Nanya et al. . | |
| 5,124,225 | 6/1992 | Shibata . | |
| 5,135,833 | 8/1992 | Matsunaga et al. | 430/904 |
| 5,176,978 | 1/1993 | Kumashiro et al. . | |
| 5,234,788 | 8/1993 | Morimoto et al. . | |
| 5,238,767 | 8/1993 | Horiie . | |
| 5,427,883 | 6/1995 | Misawa et al. | 430/109 |
| 5,501,931 | 3/1996 | Hirama et al. | 430/109 |
| 5,541,030 | 7/1996 | Sano et al. | 430/106.6 |

FOREIGN PATENT DOCUMENTS

| | | |
|---|---|---|
| 2-82267 | 3/1990 | Japan . |

OTHER PUBLICATIONS

Diamond, Arthur S. Handbook of Imaging Materials. New York: Marcel–Dekker, Inc. pp. 169–170, 1991.

*Primary Examiner*—Christopher D. Rodee
*Attorney, Agent, or Firm*—McDermott, Will & Emery

[57] ABSTRACT

The present invention provides a toner for developing an electrostatic latent image comprising:a colorant; and binder resin including a low-molecular component having a weight-average molecular weight from 3,000 to 15,000 which is obtained by gel permeation chromatography (GPC), said low-molecular component being included from 60 percent-by-weight to 80 percent-by-weight with respect to the binder resin.

31 Claims, 1 Drawing Sheet

TONER FOR DEVELOPING ELECTROSTATIC LATENT IMAGE

BACKGROUND OF THE INVENTION

1. Field of the Invention

The present invention relates to a toner for use in developing electrostatic latent images in electrophotography, electrostatic recording, electrostatic printing and the like.

Specifically, the present invention relates to a toner used in monocomponent developing to develop electrostatic latent images in electrophotography, electrostatic recording, electrostatic printing and the like.

More specifically, the present invention relates to a toner used in monocomponent developing to develop electrostatic latent images in image forming apparatus such as copiers, printers, facsimiles and the like.

2. Description of the Related Art

In the art of developing electrostatic latent images used in electrophotography, electrostatic recording, electrostatic printing and the like, toners having excellent fixing characteristics, heat resistance characteristics, or retention characteristics have been long awaited, but a perfect toner has not yet appeared.

In the art, demand for compact image forming apparatus for developing electrostatic latent images has grown recently. Thus, demand has arisen for compact developing devices used in said image forming apparatus. In the case of two-component developing methods wherein a toner and a carrier are used as a developer, a mixing mechanism must be provided to mix the developer, and said mixing mechanism is inappropriate for compact designs. Therefore, the focus has been on monocomponent developing methods as being suitable for compact designs.

Monocomponent developing methods form a thin layer of a charged toner on a sleeve by passing the toner through a gap at which a regulating blade is pressed against a sleeve, so as to develop an electrostatic latent image formed on the surface of a photosensitive member via said thin layer of toner. The formation of the thin layer of toner on the developing sleeve via the charged toner occurs in a region of pressure contact with the toner regulating blade, which puts stress on the toner and causes the toner to adhere to the developing sleeve and the regulating blade.

In addition to compact image forming apparatus, demand has arisen for toner having excellent low temperature fixing characteristics to achieve energy conservation. Energy conservation in image forming apparatus can be accomplished by fixing the toner at low temperature. Furthermore, even more suitable operational characteristics can be obtained by reducing the amount of heat required, thereby reducing the warmup time necessary for the fixing device.

Although the aforesaid toner has superior fixing characteristics, concomitant disadvantages include ready adhesion of toner on the regulating blade and developing sleeve, as well as poor heat resistance.

SUMMARY OF THE INVENTION

An object of the present invention is to provide a novel toner for developing electrostatic latent images.

Another object of the present invention is to provide a novel monocomponent toner for developing electrostatic latent images.

A further object of the present invention is to provide a monocomponent toner for developing electrostatic latent images which eliminates the previously described disadvantages.

Another further object of the present invention is to provide a monocomponent toner for developing electrostatic latent images which has excellent fixing characteristics.

A further object of the present invention is to provide a monocomponent toner for developing electrostatic latent images which has excellent anti-retention characteristics.

A still further object of the present invention is to provide a monocomponent toner for developing electrostatic latent images which has excellent heat resistance.

An even further object of the present invention is to provide a monocomponent toner for developing electrostatic latent images which has excellent fixing characteristics even at low temperatures of the fixing roller, and at the same time has excellent heat resistance and anti-retention characteristics.

The aforesaid objects of the present invention are achieved by providing a monocomponent toner for developing electrostatic latent images comprising a binder resin including a low-molecular component having a weight-average molecular weight from 3,000 to 15,000 which is obtained by gel permeation chromatography (GPC), said low-molecular component content being from 60 percent-by-weight to 80 percent-by-weight with respect to the total binder resin, and which has a pulverization index value K within a range of 0.8–2.5.

DESCRIPTION OF THE PREFERRED EMBODIMENTS

Figure 1:
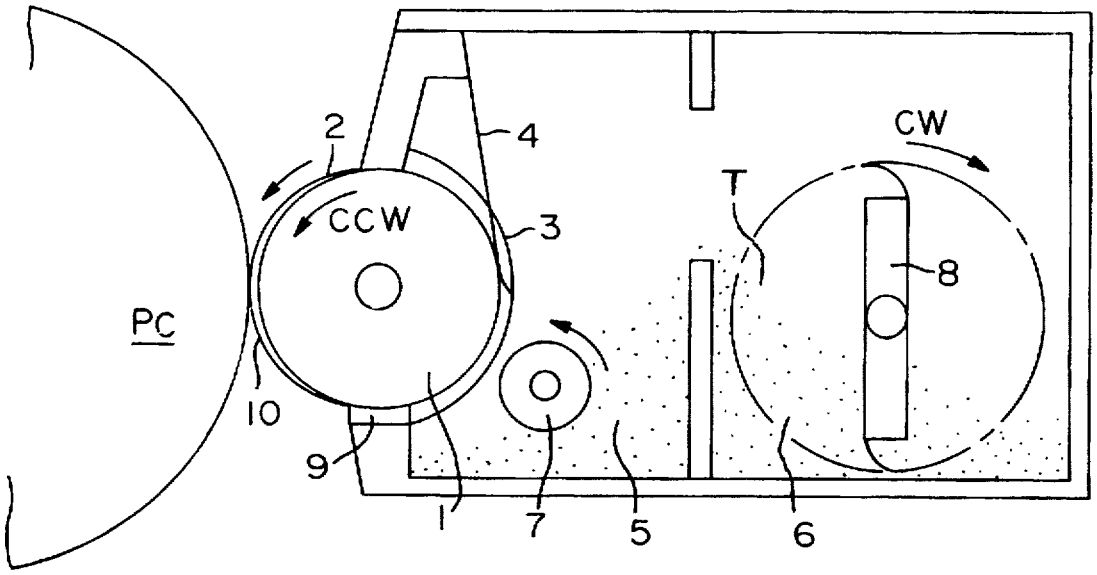
FIG. 1 briefly shows a developing device using a preferred embodiment of the toner of the present invention.

The toner of the present invention is described in detail hereinafter by way of the preferred embodiments with reference to the accompanying drawings.

It is to be noted that the present invention is not limited to the embodiments described hereinafter.

The toner of the preferred embodiments of the present invention includes main component of a low-molecular weight resin having a weight-average molecular weight (Mw) from 3,000 to 15,000, said low-molecular resin being included from 60–80 percent-by-weight with respect to the binder resin.

The low-molecular weight resin has a weight-average molecular weight of 3,000 to 15,000, and preferably 5,000 to 10,000, measured by gel permeation chromatography (GPC). Monomers such as, for example, polystyrene resin, styrene-acrylic copolymer resin, polyester resin and the like may be used. When resins having a weight-average molecular weight less than 3,000 are used, problems develop with respect to retention resistance characteristics and heat resistance characteristics. When resins having a weight-average molecular weight greater than 15,000 are used, problems develop with respect to poor fixing strength at low temperatures.

A high percentage of low-molecular weight component is effective in improving low temperature fixing characteristics. When the aforesaid percentage becomes too high, however, high temperature offset characteristics are adversely affected. Therefore, it is desirable that the percentage of low-molecular weight component is 60–80 percent-by-weight, and preferably 65–75 percent-by-weight, with respect to the total amount of binder resin. When the aforesaid percentage is too large, retention resistance characteristics are adversely affected, thereby reducing the breadth of the anti-offset range. When the percentage of low-molecular weight component is too low, fixing strength is adversely affected, and low temperature fixing effectiveness is lost.

It is desirable to use two kinds of low-molecular weight components, one being a low-molecular weight component having excellent strength and the other low-molecular weight component having excellent heat resistance, to as to attain more effective heat resistance in addition to low temperature fixing characteristics.

Low-molecular weight components having excellent strength are resins which have a weight-average molecular weight of 8,000 to 15,000, and preferably 9,000 to 13,000, measured by gel permeation chromatography (GPC), and a glass-transition temperature of 58° C. to 62° C. In the present specifications, glass transition temperature is a value measured by differential scanning calorimeter (DSC).

Low-molecular weight components having excellent strength are resins having the aforesaid weight-average molecular weight and glass transition temperature, such as polyester resins including at least structural monomers of etherificated diphenol, aromatic dicarbonate acid, and aliphatic dicarbonate acid, or styrene-acrylic copolymers, bridging type and branching type resins, or urethane resin.

Low-molecular weight components having excellent heat resistance are resins which have a weight-average molecular weight of 3,000 to 15,000, and preferably 3,000 to 9,000, measured by gel permeation chromatography (GPC), and a glass-transition temperature of 60° C. to 70° C.

Low-molecular weight components having excellent heat resistance are resins having the aforesaid weight-average molecular weight and glass transition temperature, such as linear polyester resins including at least structural monomers of etherificated diphenol, and aromatic dicarbonate acid. Linear polyester resins are polyester resins obtained by polymerization of bivalent alcohol and bivalent acid. Alternatively, the low-molecular weight components having excellent heat resistance may be styrene-acrylic copolymers; in this case the aforesaid weight-average molecular weight and glass transition temperature may be obtained by the selection of the type of acrylic and increasing the amount of styrene.

The relationship between low-molecular weight component having excellent strength and low-molecular weight component having excellent heat resistance is preferably such that the weight-average molecular weight of the low-molecular weight component having excellent strength is greater than that of the low-molecular weight component having excellent heat resistance as measured by gel permeation chromatography (GPC), and the glass transition temperature of the low-molecular weight component having excellent heat resistance is greater than that of the low-molecular weight component having excellent strength.

The toner of the preferred embodiments of the present invention preferably includes low-molecular weight components at a rate of 60 to 80 percent-by-weight, and pulverization index value of 0.8 to 2.5, and preferably 1.0 to 2.0.

The pulverization index value is an indicator of toner hardness, and is explained in detail later in the section concerning toner evaluation methods. When the pulverization index value is less than 0.8, toner readily collapses and is pulverized by mixing in the developing device which adversely affects toner durability. Furthermore, the toner is deformed through contact with the charging blade which imparts a triboelectric charge to the toner, and causes disadvantages such as retention of the toner on the aforesaid charging blade and developing sleeve.

When the pulverization index value is greater than 2.5, the toner is excessively hard and difficult to crush, thereby adversely affecting toner manufacturing characteristics.

In the preferred embodiments of the present invention, a pulverization index value of 0.8 to 2.5 can be obtained by including both the aforesaid low-molecular weight component having excellent strength and low-molecular weight component having excellent heat resistance, regardless of the inclusion of a low-molecular weight component which typically worsens pulverization characteristics.

The pulverization index value is related to smear characteristics. When the pulverization index value is less than 0.6, smear characteristics tend to deteriorate.

Toner which has poor smear characteristics is discussed below. When an image reproduced by toner is used as an original document and inserted in an automatic document feeder for copying, the reproduced image of the document is rubbed by the feed rollers of the automatic document feeder, thereby causing smudging and soiling of the image. In the cases of duplex copies and multicolor copies, the surface of the copy image is also smudged and soiled by the rubbing of the feed rollers in the second copy process. This same phenomenon occurs when a plurality of copy images are stacked and maintained temporarily within the copying apparatus and fed one sheet at a time by feed rollers for the second copy process, thereby reducing image quality.

The binder resin used in the toner of the preferred embodiments of the present invention may be produced, for example, by the methods described below.

A first low-molecular weight polyester resin A and a and high-molecular weight polyester resin B are mixed. The mixture is bonded to urethane by polyisocyanate to obtain a urethane-modified polyester resin C. A second low-molecular weight resin D is mixed with the urethane-modified polyester resin C to obtain the binder resin of the preferred embodiments of the invention.

The aforesaid resins A~D are described in detail below.

First low-molecular weight resin A corresponds to the previously mentioned low-molecular weight component having excellent heat resistance.

Specifically, it is a linear low-molecular weight polyester resin including at least an etherificated diphenol and aromatic dicarbonate structural monomers. Linear means a polyester resin obtained by polymerization of a divalent alcohol and divalent acid.

The etherificated diphenol, which is one of the structural monomers, is preferably an ethoxy or propoxy type etherificated diphenol, e.g., bisphenol A ethylene oxide compound, bisphenol A propylene oxide compound and the like.

The aromatic dicarbonate acid, which is the other structural monomer, is preferably phthalic acid and anhydride thereof, terephthalic acid, isophthalic acid, and esters thereof.

Aliphatic dicarbonate acid may be added as a structural monomer to the etherificated diphenol and aromatic dicarbonate acid. Examples of useful aliphatic dicarbonate acids include aliphatic dibasic acids such as malonic acid, succinic acid, glutaric acid, adipic acid, azelaic acid, sebacic acid and the like, and aliphatic unsaturated dibasic acids such as maleic acid, anhydrous maleic acid, fumaric acid, itaconic acid, citraconic acid and the like.

Aliphatic diols also may be added as structural monomers. Examples of useful aliphatic diols include unsaturated aliphatic glycols such as ethylene glycol, 1,2-propylene glycol, 1,3-butylene glycol, 1,4-butylene glycol, 1,6-hexane diol, neopentyl glycol, diethylene glycol, dipropylene glycol, triethylene glycol and the like.

First low-molecular weight polyester resin A can be produced by normal methods wherein at least the aforesaid etherificated diphenol and aromatic dicarbonate acid are mixed, and subjected to high-temperature condensation polymerization, solution condensation polymerization, surface condensation polymerization and the like.

The mixture ratio of etherificated diphenol and dicarbonate acid is preferably adjusted to a (carboxyl group)/(hydroxyl group) ratio of 1.1 to 1.4, and ideally 1.15 to 1.3. When the mixture ratio is greater than 1.4, resin strength is reduced, which leads to toner retention on the blade and reduced toner heat resistance. When the mixture ratio is less than 1.1, the softening point is elevated, thereby reducing toner adhesion strength. When an aliphatic dicarbonate acid is used, the aliphatic dicarbonate acid is preferably 60 molar percent or greater, and ideally 70 molar percent or greater, of the total dicarbonate acid. This percentage assures toner fixing characteristics, and imparts toughness to the toner.

First low-molecular weight polyester resin A preferably has a molecular weight (weight-average molecular weight (Mw)) of 3,000 to 15,000, and ideally 3,000 to 9,000, measured by gel permeation chromatography (GPC) and glass transition temperature (Tg) of 60° C. to 70° C., and an acid value (Av)(KOHmg/g) of less than 45. When the weight-average molecular weight is less than 3,000, problems arise with the toughness of the ultimately obtained polyester resin, and when the molecular weight is greater than 15,000, the softening point is elevated which leads to reduced toner fixing strength. When the glass transition temperature is higher than 70° C., solubility decreases, leading to reduced toner fixing characteristics. When the glass transition temperature is less than 60° C., toner heat resistance is adversely affected. When the acid value is greater than 45, problems arise with moisture resistance.

High-molecular weight polyester resin B includes as a structural monomer at least etherificated diphenol, aromatic dicarbonate acid, and polyol.

The aforesaid etherificated diphenol and dicarbonate acid may be the same monomers as used in first low-molecular weight polyester resin A.

In high-molecular weight polyester resin B, polyol may be used as a structural monomer.

The monomer used as the polyol may be one type selected from among aliphatic diol and polyol having three valences or more.

Examples of useful aliphatic diols include saturated and unsaturated aliphatic glycols such as ethylene glycol, 1,2-propylene glycol, 1,3-butylene glycol, 1,4-butylene glycol, 1,6-hexane diol, neopentyl glycol, diethylene glycol, dipropylene glycol, triethylene glycol and the like.

Examples of useful polyols having three or more valences include glycerine, trimethylol propane, triethylol ethane, triethylol propane, tributylol propane, 2-methyl propane triol, sorbitol, 1,2,3,6-hexane tetrol, 1,4-sorbitane, pentaerythritol, sucrose, 1,2,4-metatriol and the like.

High-molecular weight polyester resin B includes at least three types of monomers of etherificated diphenol, aromatic carbonate acid, and polyol in a mixture ratio (hydroxyl group)/(carboxyl group) of 1.1 to 1.4, and ideally 1.15 to 1.3. High-molecular weight polyester resin B may be produced by well-known methods of high-temperature condensation polymerization, solution condensation polymerization, and surface condensation polymerization. When the aforesaid mixture ratio is greater than 1.4, resin strength is reduced, which leads to toner retention on the blade, and reduction of toner anti-offset characteristics. When the mixture ratio is less than 1.1, disadvantages arise with respect to manufacturing due to increased reaction time for the polyisocyanate.

In the high-molecular weight polyester resin B, the percentage of hydroxyl group via polyol is desirably less than 50 molar percent, and preferably less than 40 molar percent of the total hydroxyl group content. When the aforesaid percentage is greater than 50 molar percent, the amount insoluble in the urethane-modified polyester resin C described later becomes too large, thereby greatly reducing resin strength, and causing toner to be readily retained on the blade.

Useful examples of the structural monomers which can be added to high-molecular weight polyester resin B include aliphatic dicarbonate acid, the aforesaid etherificated diphenol, aromatic dicarbonate acid, and polyol. Examples of useful aliphatic dicarbonate acids include aliphatic dibasic acids such as malonic acid, succinic acid, glutaric acid, adipic acid, azelaic acid, sebacic acid and the like, and aliphatic unsaturated dibasic acids such as maleic acid, anhydrous maleic acid, fumaric acid, itaconic acid, citraconic acid and the like.

High-molecular weight polyester resin B preferably has a molecular weight (weight-average molecular weight (Mw)) of 5,000 to 12,000 measured by gel permeation chromatography (GPC) and glass transition temperature (Tg) of 20° C. to 50° C. When the weight-average molecular weight is less than 5,000, the effectiveness of the chain extension process (described later) is inadequately achieved. When the glass transition temperature is lower than 20° C., the glass transition temperature of the ultimately obtained urethane-modified polyester resin C becomes too low. When the glass transition temperature is higher than 50° C., the softening point of the obtained polyester resin is elevated, thereby reducing fixing characteristics and fixing strength. Furthermore, problems arise with respect to manufacturing characteristics due to an increased reaction time with the polyisocyanate.

The aforesaid first low-molecular weight polyester resin A and high-molecular weight polyester resin B are mixed, and subjected to chain extension reaction in the presence of isocyanate to obtain urethane-modified polyester resin C.

In the aforesaid chain extension reaction, the chain extension occurs with respect to high-molecular weight polyester resin B. The reason for this exclusivity is that first low-molecular weight polyester resin A has COOH group surplus, and high-molecular weight polyester resin B has OH group surplus. Therefore, the isocyanate group reacts almost exclusively with the high-molecular weight polyester resin B since isocyanate reaction speed with OH is about 400 times faster than its reaction speed with COOH.

The aforesaid chain extension reaction may be accomplished by reacting isocyanate with a uniform mixture of first low-molecular weight polyester resin A and high-molecular weight polyester resin B in A thermally fused state.

Examples of useful isocyanate which may be added to the aforesaid polyester resins A and B include hexane methylene isocyanate, isophorone diisocyanate, tolylene isocyanate, diphenyl methane-4,4'-diisocyanate, xylene diisocyanate, or tetramethyl xylene isocyanate.

The isocyanate group is added so as to attain a molar ratio (NCO/OH) of the added isocyanate group (NCO) with respect to the hydroxyl group of high-molecular weight polyester resin B that is preferably 0.8 to 1.5, and ideally 1.0 to 1.3.

The chain extension reaction is performed to obtain a urethane-modified polyester resin C having physical characteristics of a glass transition temperature of 60° C. to 80° C., softening point of 110° C. to 170° C., and acid value of 25 KOHmg/g.

The aforesaid binder resin of the preferred embodiments of the present invention may be mixed with said urethane-modified polyester resin C to obtain a second low-molecular weight polyester resin D which is described below.

Second low-molecular weight polyester resin D corresponds to the previously mentioned low-molecular weight component having excellent strength characteristics, and comprises etherified diphenol, aromatic dicarbonate, and aliphatic monomer. The weight-average molecular weight of the resin is preferably 8,000 to 15,000, and ideally 9,000 to 13,000, measured by gel permeation chromatography (GPC), and has a glass transition temperature of 58° C. to 62° C.

The structural monomers of etherificated diphenol and aromatic dicarbonate acid may be the etherificated diphenol and aromatic dicarbonate acid used in first low-molecular weight polyester resin A. In second low-molecular weight polyester resin D, the (carboxyl group)/(hydroxyl group) ratio specified in the desirable range for producing first low-molecular weight polyester resin A is not specifically required.

Aliphatic dicarbonate acid is desirable as an aliphatic monomer. Examples of useful aliphatic dicarbonate acids include aliphatic dibasic acids such as malonic acid, succinic acid, glutaric acid, adipic acid, azelaic acid, sebacic acid and the like, and aliphatic unsaturated dibasic acids such as maleic acid, anhydrous maleic acid, fumaric acid, itaconic acid, citraconic acid and the like.

The toner binder resin of the preferred embodiments of the present invention may be a mixture of the previously described urethane-modified polyester resin C and second low-molecular weight polyester resin D. In this case, the total amount of first low-molecular weight polyester resin A and second low-molecular weight polyester resin D may be 60 to 80 percent-by-weight with respect to the total amount of binder resin. (In the structure of the urethane-modified polyester resin C, the chain extension via isocyanate compound occurs exclusively with respect to high-molecular weight polyester resin B. Therefore, first low-molecular weight polyester resin A within urethane-modified polyester resin C exists in its original molecular weight.)

The toner of the preferred embodiments of the present invention may include an anti-offset agent.

Although synthetic waxes such as low-molecular weight polyolefins and natural waxes such as carnauba wax may be used as anti-offset agents, oxided waxes are preferable from the perspectives of affinity with the binder resin, dispersion of small particles, and lack of affect on retention characteristics.

Oxided polyolefins may be obtained by grafting unsaturated carbonate acid and polyolefin, or oxidative destruction of decomposition low-molecular weight polyolefin by ozone. Specifically, examples of usable materials include oxided low-molecular weight polypropylene wax (TS200; Sanyo Kasei K.K.), oxided polyethylene wax (E-300, E-250; Sanyo Kasei K. K.)

The amount of added anti-offset agent is preferably 1.0 to 5.0 parts-by-weight, and ideally 2.0 to 4.0 parts-by-weight relative to 100 parts-by-weight of binder resin. When the added amount exceeds 5.0 parts-by-weight, toner retention occurs, and developer fluidity is lost, whereas when the added amount is less than 1.0 parts-by-weight, offset occurs.

The toner of the preferred embodiment of the present invention may include magnetic powder.

The toner of the preferred embodiments of the present invention may include well-known dyes and pigments as colorants, and may be contained in a magnetic powder.

The toner of the preferred embodiments of the present invention may also have additives as necessary in addition to the aforesaid materials such as charge-controlling agents (e.g., negative charge charge-controlling agents which may contain metal or be metal free, and positive charge charge-controlling agents such as nigrosine or triphenyl methane), fluidizing enhancers (colloidal silica and the like), resin beads as cleaning enhancers (teflon, polyethylene, silicone, styrene resin, acrylic resin).

The toner of the preferred embodiments of the present invention may be obtained by mixing and kneading the aforesaid additives of binder resins, colorant, anti-offset agent and the like, and subsequently pulverizing and classifying same.

The toner of the preferred embodiments of the present invention is suitable for nonmagnetic monocomponent developing devices having the basic construction shown in FIG. 1. The nonmagnetic monocomponent developing device in FIG. 1 is provided with a drive roller 1 which is rotatably driven in a counterclockwise (CCW) direction by a drive means not shown in the drawing, said drive roller 1 being covered by a developing sleeve 2 which has an interior diameter slightly larger than the exterior diameter of said roller. Bilateral ends of developing sleeve 2 press against drive roller 1 via pressure guide 3 disposed behind said sleeve, such that the slack portion 10 formed on the opposite of said pressure contact is brought into light contact with the electrostatic latent image-bearing member (photosensitive drum) PC. Toner regulating blade 4 presses against developing sleeve 2 on the same side as pressure guide 3.

Behind developing sleeve 2 is provided a buffer compartment 5 behind which is provided a toner supply vessel 6. A toner supply member 7 (rotatable in the CCW direction) is provided in buffer compartment 5, and a mixing/supplying member 8 (rotatable in the clockwise (CW) direction) is provided in toner supply vessel 6.

A seal member 9 is provided below developing sleeve 2 to prevent leakage of toner from compartment 5.

According to the aforesaid developing device, nonmagnetic monocomponent toner T is transported from toner vessel 6 to buffer compartment 5 via the rotation of member 8, and sequentially supplied to the surface of developing sleeve 2 via the rotation of toner supply member 7. on the other hand, developing sleeve 2 is driven in rotation via the friction force produced by the rotation of drive roller 1, and the supplied toner T passes between toner regulating blade 4 and said sleeve 2, so as to be triboelectrically charged under pressure with said blade 4, and achieve a predetermined thin layer of toner T. The thin toner layer is maintained on the surface of developing sleeve 2, and transported to the developing region confronting photosensitive drum PC to develop an electrostatic latent image formed thereon.

The excess toner remaining on developing sleeve 2 passes between developing sleeve 2 and intermediate seal member 9 and is returned to buffer compartment 5.

Although an example has been given of the nonmagnetic monocomponent developing device using the monocomponent toner of the present invention, use is not limited to said device. For example, in the developing device of FIG. 1, developing sleeve 2 has a an interior diameter slightly larger than the exterior diameter of the drive roller so as to form a slack portion 10, but a developing sleeve having a construction without said slack portion 10, i.e., having an interior diameter equal to the exterior diameter of the drive roller may be used.

EXPERIMENTAL EXAMPLES

First low-molecular weight polyester resin A

A reflux condenser, moisture separator, $N_2$ gas tube, thermometer, and mixing device were attached to a 5-liter capacity 4-mouth flask and installed on a mantle heater, and 1,376 g of bisphenol propylene oxide and 472 g isobutylate were introduced to the flask. As $N_2$ gas was introduced to the flask, the material was subjected to dehydration polycondensation at 220° C. to 270° C., to obtain first low-molecular weight polyester resin A. The obtained polyester had physical characteristics which include glass transition temperature (Tg) of 64° C., softening temperature (Tm) of 110° C., number-average molecular weight Mn of 2,500, and weight-average molecular weight (Mw) of 6,000 measured by gel permeation chromatography (GPC).

High-molecular weight polyester resin B

A reflux condenser, moisture separator, $N_2$ gas tube, thermometer, and mixing device were attached to a 5-liter capacity 4-mouth flask and installed on a mantle heater, and 1,720 g of bisphenol propylene oxide, 860 g of isobutylate, 119 g of succinic acid, 129 g of diethylene glycol, and 74.6 g of glycerine were introduced to the flask. As $N_2$ gas was introduced to the flask, the material was subjected to dehydration polycondensation at 240° C., to obtain high-molecular weight polyester resin B. The obtained polyester had physical characteristics which include glass transition temperature (Tg) of 42° C., and weight-average molecular weight (Mw) of 7,000 measured by gel permeation chromatography (GPC).

Urethane-modified polyester resin C

To 60 parts first low-molecular weight polyester resin A were added 40 parts high-molecular weight polyester resin B and the material was mixed in a henschel mixer to attain a uniform dry blend.

Then, the dry blend mixture was placed in a heating kneader, and reacted for 1hr at 20° C. with 1.42 parts diphenyl methane-4,4-diisocyanate (MDI). After the absence of residual isocyanate group was confirmed by measuring the NCO percentage, the reactant was cooled, to obtain a polyester resin having urethane bonds. The obtained polyester resin has physical characteristics which include glass transition temperature (Tg) of 65° C., softening temperature of 145° C., acid value (Av) of 22 KOHmg/g.

Second low-molecular weight polyester resin D

A reflux condenser, moisture separator, $N_2$ gas tube, thermometer, and mixing device were attached to a 5-liter capacity 4-mouth flask and installed on a mantle heater, and 1,376 g of bisphenol propylene oxide, 398 g of isobutylate, 113 g of succinic acid, 85 g of diethylene glycol were introduced to the flask. As $N_2$ gas was introduced to the flask, the material was subjected to dehydration polycondensation at 220° C. to 270° C., to obtain second low-molecular weight polyester resin D. (Tg=60° C., Tm=100° C., Mn=5,000, and Mw=12,000 measured by gel permeation chromatography (GPC).

Urethane-modified polyester resin C'

To 30 parts first low-molecular weight polyester resin A were added 70 parts high-molecular weight polyester resin B and the material was mixed in a henschel mixer to attain a uniform dry blend. Then, the dry blend mixture was placed in a heating kneader, and reacted for 1 hr at 120° C. with 2.5 parts MDI to obtain urethane-modified polyester resin C'. (Tg=70° C., Tm=45° C., Av=11.5)

Urethane-modified polyester resin C"

To 90 parts first low-molecular weight polyester resin A were added 10 parts high-molecular weight polyester resin B and the material was mixed in a henschel mixer to attain a uniform dry blend. Then, the dry blend mixture was placed in a heating kneader, and reacted for 1 hr at 120° C. with 0.36 parts MDI to obtain urethane-modified polyester resin C'. (Tg=58° C., Tm=108° C., Av=37)

Second low-molecular weight polyester resin D'

A reflux condenser, moisture separator, $N_2$ gas tube, thermometer, and mixing device were attached to a 5-liter capacity 4-mouth flask and installed on a mantle heater, and 1,376 g of bisphenol propylene oxide, 553 g of isobutylate, 113 g of succinic acid, 85 g of diethylene glycol were introduced to the flask. As $N_2$ gas was introduced to the flask, the material was subjected to dehydration polycondensation at 220° C. to 270° C., to obtain second low-molecular weight polyester resin D'. (Tg=64° C., Tm=120° C., Mn=6,000, and Mw=20,000 measured by gel permeation chromatography (GPC).

Toner Production

The materials described in experimental examples 1~8 below were mixed using a henschel mixer, then kneaded using a twin-shaft extrusion kneader. The kneaded material was cooled, and coarsely pulverized sing a 2 mm mesh in a feather mill. The coarsely pulverized material was finely pulverized using a jet mill type fine pulverization device, and classified using a forced air classification device to obtain toner particles having a mean particle size of 8.5 μm.

Experimental example 1

| | Parts |
|---|---|
| Urethane-modified polyester resin C | 90 |
| 2nd low-molecular polyester resin D | 10 |
| Carbon black (Mogal L; Cabot) | 5 |
| Low-molecular polypropylene (Biscol TS-200; Sanyo Kasei K.K.) | 5 |
| Carnauba wax (Kato Yoko K.K.) | 1.5 |
| Charge-controlling agent Bontron S-34; Oriental Chemical) | 2 |

In this example, the weight-average molecular weight Mw was about 6,900 measured by gel permeation chromatography (GPC). The percentage of low-molecular weight toner binding resin was about 64 percent-by-weight.

Experimental example 2

| | Parts |
|---|---|
| Urethane–modified polyester resin C | 50 |
| 2nd low–molecular polyester resin D | 50 |
| Carbon black (Mogal L; Cabot) | 5 |
| Low–molecular polypropylene (Biscol TS–200; Sanyo Kasei K.K.) | 1 |
| Carnauba wax (Kato Yoko K.K.) | 1.5 |
| Charge–controlling agent Bontron S-34; Oriental Chemical) | 2 |

In this example, the weight-average molecular weight Mw was about 9,800 measured by gel permeation chromatography (GPC). The percentage of low-molecular weight toner binding resin was about 80 percent-by-weight.

Experimental example 3

| | Parts |
|---|---|
| Urethane–modified polyester resin C | 80 |
| 2nd low–molecular polyester resin D | 20 |
| Carbon black (Mogal L; Cabot) | 5 |
| Low–molecular polypropylene (Biscol TS–200; Sanyo Kasei K.K.) | 5 |
| Carnauba wax (Kato Yoko K.K.) | 1.5 |
| Charge–controlling agent Bontron S-34; Oriental Chemical) | 2 |

In this example, the weight-average molecular weight Mw was about 6,500 measured by gel permeation chromatography (GPC). The percentage of low-molecular weight toner binding resin was about 68 percent-by-weight.

Experimental example 4

| | Parts |
|---|---|
| Urethane–modified polyester resin C | 60 |
| 2nd low–molecular polyester resin D | 40 |
| Carbon black (Mogal L; Cabot) | 5 |
| Low–molecular polypropylene (Biscol TS–200; Sanyo Kasei K.K.) | 1 |
| Carnauba wax (Kato Yoko K.K.) | 1.5 |
| Charge–controlling agent Bontron S-34; Oriental Chemical) | 2 |

In this example, the weight-average molecular weight Mw was about 8,600 measured by gel permeation chromatography (GPC). The percentage of low-molecular weight toner binding resin was about 76 percent-by-weight.

Experimental example 5

| | Parts |
|---|---|
| Urethane–modified polyester resin C | 100 |
| Carbon black (Mogal L; Cabot) | 5 |
| Low–molecular polypropylene (Biscol TS–200; Sanyo Kasei K.K.) | 1 |
| Carnauba wax (Kato Yoko K.K.) | 1.5 |
| Charge–controlling agent Bontron S-34; Oriental Chemical) | 2 |

In this example, the weight-average molecular weight Mw was about 6,000 measured by gel permeation chromatography (GPC). The percentage of low-molecular weight toner binding resin was about 60 percent-by-weight.

Experimental example 6

| | Parts |
|---|---|
| Urethane–modified polyester resin C' | 70 |
| 2nd low–molecular polyester resin D | 30 |
| Carbon black (Mogal L; Cabot) | 5 |
| Low–molecular polypropylene (Biscol TS–200; Sanyo Kasei K.K.) | 1 |
| Carnauba wax (Kato Yoko K.K.) | 1.5 |
| Charge–controlling agent Bontron S-34; Oriental Chemical) | 2 |

In this example, the weight-average molecular weight Mw was about 9,500 measured by gel permeation chromatography (GPC). The percentage of low-molecular weight toner binding resin was about 51 percent-by-weight.

Experimental example 7

| | Parts |
|---|---|
| Urethane–modified polyester resin C" | 100 |
| Carbon black (Mogal L; Cabot) | 5 |
| Low–molecular polypropylene (Biscol TS–200; Sanyo Kasei K.K.) | 1 |
| Carnauba wax (Kato Yoko K.K.) | 1.5 |
| Charge–controlling agent Bontron S-34; Oriental Chemical) | 2 |

In this example, the weight-average molecular weight Mw was about 6,000 measured by gel permeation chromatography (GPC). The percentage of low-molecular weight toner binding resin was about 90 percent-by-weight.

Experimental example 8

| | Parts |
|---|---|
| Urethane–modified polyester resin C | 50 |
| 2nd low–molecular polyester resin D' | 50 |
| Carbon black (Mogal L; Cabot) | 5 |
| Low–molecular polypropylene (Biscol TS–200; Sanyo Kasei K.K.) | 1 |
| Carnauba wax (Kato Yoko K.K.) | 1.5 |
| Charge–controlling agent Bontron S-34; Oriental Chemical) | 2 |

In this example, the weight-average molecular weight Mw was about 14,700 measured by gel permeation chromatography (GPC). The percentage of low-molecular weight toner binding resin was about 80 percent-by-weight.

Hydrophobic silica (Viscol TS-500; Cabot) was added to the toner particles obtained in the aforesaid experimental examples at the rate of 0.8 parts per 100 parts toner and the materials were mixed in a henschel mixer to obtain the toner.

Evaluation methods

The obtained toners were evaluated for retention characteristics, anti-offset range, fixing strength, and smear characteristics using an electrophotographic printer (model SP100; Minolta Co., Ltd. (system speed: 35 mm/sec)).

The developing device used in this printer had a construction identical to the developing device of FIG. 1.

Retention characteristics

Toner was loaded in the developing device (photosensitive member not installed) of electrophotographic printer SP100, and the sleeve was rotated continuously for 30 min. The blade was examined for toner retention and the sleeve was examined for white streaks. The presence of white streaks is indicated by the symbol X, whereas the absence of white streaks is indicated by the symbol ○.

Heat resistance

Five grams of toner were introduced to glass beads, and maintained for 5 hr at 60° C. Toner flocculation is indicated by the symbol X, whereas a lack of flocculation is indicated by the symbol ○.

Anti-offset range

Toner images were fixed when changing the temperature of the roller from 110° C. to 220° C. in 5° C. increments, and the temperature range in which offset does not occur was determined. The anti-offset range must be 140°±20°.

Fixing strength

Figure 2:
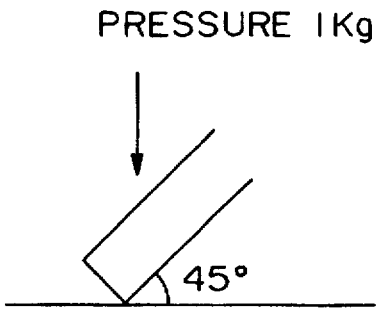
FIG. 2 briefly illustrates the method of measuring the fixing strength of a preferred embodiment of the toner of the present invention.

Toner images were fixed with the roller temperature set at 140° C. to 170° C., and the portion at which image density ID was within a range of 1.35~1.45 was erased with a rubber eraser with three reciprocal strokes as shown in FIG. 2.

Expression 2

$K=(W1-W2)D1/F$

This expression is limited to $D0>>D1$.

When the above conditions are not satisfied, the pulverization index value K is determined by the following expression.

Expression 3

$K=(W1-W2)/F\times D0D1/(D0-D1)$

In the above expression 2 and 3, the following definitions obtain.

K: pulverization index (W-hr-μm/Kg)

D0: pre-pulverization particle size (μm)

D1: post pulverization particle size (μm)

W1: power during pulverization (W)

W2: power under load (W)

F: supply amount of toner (kg/hr)

The evaluation results are shown in Table 1.

Although the present invention has been fully described by way of examples with reference to the accompanying drawings, it is to be noted that various changes and modifications will be apparent to those skilled in the art. Therefore, unless otherwise such changes and modification depart from the scope of the present invention, they should be construed as being included therein.

TABLE 1

| | Ex. 1 | Ex. 2 | Ex. 3 | Ex. 4 | Ex. 5 | Ex. 6 | Ex. 7 | Ex. 8 |
|---|---|---|---|---|---|---|---|---|
| Anti-offset range | 120~205° C. | 120~175° C. | 120~200° C. | 120~185° C. | 130~220° C. or higher | 120~220° C. | 12~130° C. | 130~220° C. or higher |
| Fixing Strength (140° C.) | 85% | 90% | 86% | 88% | 65% | 65% | 95% | 75% |
| Fixing Strength (170° C.) | 95% | 97% | 95% | 96% | 90% | 80% | 88% | 90% |
| Pulverization index | 2.4 | 0.8 | 1.9 | 1.2 | 2.8 | 2.9 | 0.5 | 1.8 |
| Heat Resistance | ○ | ○ | ○ | ○ | ○ | ○ | X | ○ |
| Retention Resistance | ○ | ○ | ○ | ○ | ○ | ○ | X | ○ |

Thereafter, the ID density was measured and fixing strength calculated using the expressions below. A fixing strength of 85% or greater is required.

Expression 1

Fixing strength=(post erasure ID/pre-erasure ID)×100 (%)

Pulverization index value

A mechanical pulverizer, i.e., Criptron pulverizer (model KTM-1; Kawasaki Heavy Industries, Ltd.), was installed in an open circuit, and the work load value WO (W) of the pulverization rotor motor was recorded under the following conditions: rotor rpm=9,300, total airflow=7.0 $nm^3$/min. Then, the intermediate raw materials of the toner of each experimental example, i.e., the material coarsely pulverized by a feather mill using a 2 mm mesh (coarse material prior to jet mill pulverization), having a mean particle size D0 was supplied at a rate of (F) 40 kg/hr via a constant volume feeder. The load on the pulverization rotor was increased and the work load W1 (W) was recorded at that time. After pulverization, the mean particle size D1 was measured by Coulter Counter. The pulverization index value K was determined by the following expression.

What is claimed is:

1. A toner for developing an electrostatic latent image comprising:

a colorant; and a binder resin including a low-molecular weight resin having a weight-average molecular weight from 3,000 to 15,000 which is measured by gel permeation chromatography (GPC), said low-molecular weight resin being included from 60 percent-by-weight to 80 percent-by-weight with respect to the binder resin, said low-molecular weight resin including a first resin and a second resin, the weight-average molecular weight of the first resin being smaller than that of the second resin, and said first resin having a glass transition temperature of 60° C. to 70° C. and said second resin having a glass transition temperature of 58° C. to 62° C., and said first resin having the weight-average molecular weight of 3,000 to 9,000 and said second resin having the weight-average molecular weight of 8,000 to 15,000.

2. The toner of claim 1 wherein the toner has a pulverization index value from 0.8 to 2.5.

3. The mono-component toner of claim 1 wherein the mono-component toner is free from magnetic material.

4. A mono-component toner for developing an electrostatic latent image comprising:

a colorant; and a binder resin including a low-molecular weight resin having a weight-average molecular weight from 3,000 to 15,000 which is measured by gel permeation chromatography, said low-molecular weight resin being included from 60 percent-by-weight to 80 percent-by-weight with respect to the binder resin, said low-molecular weight resin including a first resin and a second resin, the weight-average molecular weight of the first resin being smaller than that of the second resin, and said low-molecular weight resin being polyester resin.

5. The mono-component toner of claim 4 wherein the toner has a pulverization index value from 0.8 to 2.5.

6. The mono-component toner of claim 5 wherein the toner has a pulverization index value from 1.0 to 2.0.

7. The mono-component toner of claim 4 wherein the low-molecular weight resin is included from 65 percent-by-weight to 75 percent-by-weight with respect to the binder resin.

8. The mono-component toner of claim 4 wherein the low-molecular weight resin has an acid value of 45 KOH/mg or less.

9. The mono-component toner of claim 4 wherein the binder resin includes an amount of 60 percent-by-weight to 80 percent-by-weight of low-molecular polyester resin and an amount of 40 percent-by-weight to 20 percent-by-weight of urethane-modified polyester resin.

10. The mono-component toner of claim 4 wherein the first resin is polymerized from an etherificated diphenol and an aromatic dicarbonate acid and the second resin is polymerized from an etherificated diphenol, an aromatic dicarbonate acid and an aliphatic dicarbonate acid, wherein an amount of the aromatic dicarbonate acid of the first resin is larger than that of the second resin.

11. The mono-component toner of claim 4 wherein the toner further comprises an anti-offset material which is from 1 part-by-weight to 5 parts-by-weight with respect to 100 parts by weight of the binder resin.

12. The mono-component toner of claim 11 wherein the anti-offset material includes polyolefin wax and natural wax.

13. The mono-component toner of claim 12 wherein the polyolefin wax is oxidized polyolefin wax.

14. The mono-component toner of claim 12 wherein the natural wax is carnauba wax.

15. The mono-component toner of claim 4 wherein the mono-component toner is free from magnetic material.

16. The mono-component toner of claim 4 wherein the mono-component toner includes magnetic material.

17. The mono-component toner of claim 4 wherein the first resin has a weight-average molecular weight of 3,000 to 9,000 and the second resin has a weight-average molecular weight of 8,000 to 15,000.

18. The mono-component toner of claim 17 wherein the first resin has a glass transition temperature of 60° C. to 70° C. and the second resin has a glass transition temperature of 58° C. to 62° C.

19. A mono-component toner for use in a developing apparatus in which the toner is electrically charged by contacting with a restricting member comprising:

a colorant; and a binder resin including a low-molecular weight resin having a weight-average molecular weight from 3,000 to 15,000 which is measured by gel permeation chromatography and urethane modified polyester resin, said low-molecular weight resin being included from 60 percent-by-weight to 80 percent-by-weight with respect to the binder resin and said urethane modified polyester resin being included from 40 percent-by-weight to 20 percent-by-weight with respect to the binder resin.

20. The mono-component toner of claim 19 wherein the binder resin is obtained by the following process comprising:

polymerizing a first polyester resin from an etherificated diphenol and an aromatic dicarbonate acid;

polymerizing a second polyester resin from a polyol, an etherificated diphenol and an aromatic dicarbonate acid;

firstly mixing the first polyester resin and the second polyester resin to obtain a mixture;

urethane modifying of the mixture by adding an isocyanate monomer to the mixture;

polymerizing a third polyester resin from an etherificated diphenol, an aromatic dicarbonate acid and an aliphatic dicarbonate acid; and secondly mixing the third polyester resin and the urethane modified mixture.

21. The mono-component toner of claim 20 wherein the first polyester resin has a weight-average molecular weight of 3,000 to 9,000 and a glass transition temperature of 60° C. to 70° C.

22. The mono-component toner of claim 20 wherein the third polyester resin has a weight-average molecular weight of 8,000 to 15,000 and a glass transition temperature of 58° C. to 62° C.

23. The mono-component toner of claim 20 wherein the first polyester resin has a polymerized ratio of carboxyl group to hydroxyl group from 1.1 to 1.4.

24. The mono-component toner of claim 20 wherein the second polyester resin has a polymerized ratio of hydroxy group to carboxyl group from 1.1 to 1.4.

25. The mono-component toner of claim 19 wherein the mono-component toner further comprises an anti-offset material.

26. The mono-component toner of claim 19 wherein the low-molecular weight resin includes a first resin and a second resin, and the weight-average molecular weight of the first resin being smaller than that of the second resin.

27. A mono-component toner for use in a developing apparatus in which the toner is electrically charged by contacting with a restricting member comprising:

a colorant;

a binder resin including a low-molecular weight resin having a weight-average molecular weight from 3,000 to 15,000 which is measured by gel permeation chromatography, and a polyolefin wax as an anti-offset material which is included from 1 part-by-weight to 5 parts-by-weight with respect to 100 parts-by-weight of the binder resin, said low-molecular weight resin being included from 60 percent-by-weight to 80 percent-by-weight with respect to the binder resin, said low-molecular weight resin including a first resin and a second resin, the weight-average molecular weight of the first resin being smaller than that of the second resin, and said low-molecular weight resin being polyester resin.

28. The mono-component toner of claim 27 wherein the polyolefin wax is oxidized polyolefin wax.

29. The mono-component toner of claim 27 wherein the mono-component toner is free from magnetic material.

30. The mono-component toner of claim 27 wherein the mono-component toner has a pulverization index value from 0.8 to 2.5.

31. The mono-component toner of claim 30 wherein the mono-component toner has a pulverization index value from 1.0 to 2.0.

* * * * *